US008672726B2

(12) United States Patent
Ribbe

(10) Patent No.: US 8,672,726 B2
(45) Date of Patent: Mar. 18, 2014

(54) METHODS OF COMPLETING A REMOTELY CONTROLLED MODEL VEHICLE SYSTEM WITH A SEPARATE CONTROLLER

(75) Inventor: David Ribbe, Mahomet, IL (US)

(73) Assignee: Horizon Hobby, Inc., Champaign, IL (US)

( * ) Notice: Subject to any disclaimer, the term of this patent is extended or adjusted under 35 U.S.C. 154(b) by 921 days.

(21) Appl. No.: 12/262,425

(22) Filed: Oct. 31, 2008

(65) Prior Publication Data

US 2010/0112897 A1 May 6, 2010

(51) Int. Cl.
*A63H 30/00* (2006.01)
*G08B 1/08* (2006.01)

(52) U.S. Cl.
USPC ..... 446/454; 446/456; 340/539.1

(58) Field of Classification Search
USPC ..... 446/454–455, 456; 340/539.1, 539.11, 340/12.5
See application file for complete search history.

(56) References Cited

U.S. PATENT DOCUMENTS 6,697,415 B1 2/2004 Mahany
7,391,320 B1 * 6/2008 Beard et al. ..... 340/539.1
2004/0239268 A1 12/2004 Grubba
2005/0157668 A1 7/2005 Sivan
2006/0111048 A1 * 5/2006 Inomata ..... 455/66.1
2008/0100250 A1 5/2008 Norman
2009/0017714 A1 * 1/2009 DeRennaux et al. ..... 446/93

FOREIGN PATENT DOCUMENTS

JP 2008-259573 10/2008
WO WO 2007/050218 A2 5/2007

OTHER PUBLICATIONS

European Search Report, 09174746.9-2318, Horizon Hobby, Inc., Jul. 4, 2010.

* cited by examiner

*Primary Examiner* — William Brewster
*Assistant Examiner* — Alex F. R. P. Rada, II
(74) *Attorney, Agent, or Firm* — Cook Alex Ltd.

(57) ABSTRACT

Methods of establishing a fully operable remotely controlled model vehicle system for a model vehicle. The method includes the steps of transferring a model vehicle, including a receiver for receiving a control signal from a remote control signal source to control operation of the model vehicle, the transfer being from a first party to a second party, and the transfer taking place without the remote control signal source, and the second party providing the remote control signal source following transfer of the model vehicle to the second party to complete the fully operable remotely controlled model vehicle system. The transfer from the first party to the second party may be a sale of the model vehicle with the receiver, but without the remote control signal source.

16 Claims, 4 Drawing Sheets

METHODS OF COMPLETING A REMOTELY CONTROLLED MODEL VEHICLE SYSTEM WITH A SEPARATE CONTROLLER

FIELD OF THE INVENTION

The present invention relates generally to methods and apparatus for remotely controlling model vehicles and, more particularly, to methods of completing a remotely controlled model vehicle system with a separate controller.

BACKGROUND OF THE INVENTION

Prior art remotely controlled model vehicles, such as model aircraft, model helicopters, model cars, model trucks, and the like, are typically sold as a complete operating system, including a model aircraft, a plurality of servomechanisms for controlling the throttle and the control surfaces of the model aircraft, a controller for controlling the model aircraft, and a receiver for receiving control signals from the controller and for providing signals to the respective servos for controlling the flight of the model aircraft.

Controllers and receivers have traditionally been matched in frequency, or have a plurality of selectable frequencies or channels. Both the controller and the receiver must be on the same channel or frequency for the receiver to receive control signals from the controller. For example, receivers/controllers are commonly available with between 2 to 50 channels. Due to such variances in the number of channels and the frequencies utilized, a controller for one model vehicle is generally not useable with a different model vehicle. Thus, each time that a model enthusiast wishes to purchase a new model vehicle, he/she has been required to purchase a complete system such that the controller and the receiver are a matched set and are capable of communicating with each other.

Further, it is often necessary to change the initially selected operating channel or frequency when using the model vehicle near other users or model vehicles to avoid having two model vehicles which are operating on the same channel or frequency. Of course, when the channel or frequency is changed, the change may be to a channel or frequency already in use by someone else, thereby necessitating still further change such that all model vehicles in the vicinity are operating on different or distinct channels or frequencies. Similarly, the prior art 72 MHz frequency controllers need to use different frequency pins to assure that the controllers are operating on different frequencies to avoid interference.

The controller is typically an appreciable portion of the cost of a completely packaged model vehicle. It is not uncommon for the controller to be the most expensive component of the system. Thus, the cost of the complete model vehicle system limits the number of model vehicles which many users can afford. In order to alleviate these affordability issues, Horizon Hobby, Inc. of Champaign, Ill. 61822 has previously marketed certain model aircraft under its Plug-n-Play trademark. One such model is the Mini Pulse XT PNP model airplane. These Plug-n-Play models were supplied with the motor and the micro-servomechanisms preinstalled on the model vehicle. However, a battery pack, controller, receiver and charger were not included. Since the controller and the receiver had matched frequency capabilities, the user could conveniently remove the battery pack and receiver from one Plug-n-Play model and quickly install the battery pack and receiver on a compatible Plug-n-Play model. Thus, the costs associated with owning multiple model vehicles were reduced since the same battery pack, receiver and controller could be used with multiple model vehicles. Nevertheless, some users would prefer not to incur the inconvenience in swapping the battery pack and receiver between different model vehicles.

SUMMARY OF THE INVENTION

The present invention is directed to methods of establishing a fully operable remotely controlled model vehicle system for a model vehicle. In one embodiment, the method includes the steps of transferring a model vehicle, including a receiver for receiving a control signal from a remote control signal source to control operation of the model vehicle, the transfer being from a first party to a second party, and the transfer taking place without the remote control signal source, and the second party providing the remote control signal source following transfer of the model vehicle to the second party to complete the fully operable remotely controlled model vehicle system. For example, the transfer from the first party to the second party may be a sale of the model vehicle with the receiver, but without the remote control signal source.

The remote control signal source may be a controller which transmits control signals to the receiver in the model vehicle, such as radio frequency signals or digital spread spectrum modulation signals. The receiver may have a preprogrammed globally unique identifier or code.

The remote control signal source communicates with the receiver to bind the receiver to the remote control signal source with the code. After binding with the remote control signal source, the receiver only acts on signals from the remote control signal source which include the code. The remote control signal source may also bind to other model vehicles which utilize a different code.

BRIEF DESCRIPTION OF THE DRAWINGS

The invention, together with its objects and the advantages thereof, may best be understood by reference to the following description taken in conjunction with the accompanying drawings, in which like reference numerals identify like elements in the figures, and in which.

DESCRIPTION OF THE PREFERRED EMBODIMENTS

It will be understood that the present invention may be embodied in other specific forms without departing from the spirit thereof. The present examples and embodiments, therefore, are to be considered in all respects as illustrative and not restrictive, and the invention is not to be limited to the details presented herein.

Figure 1:
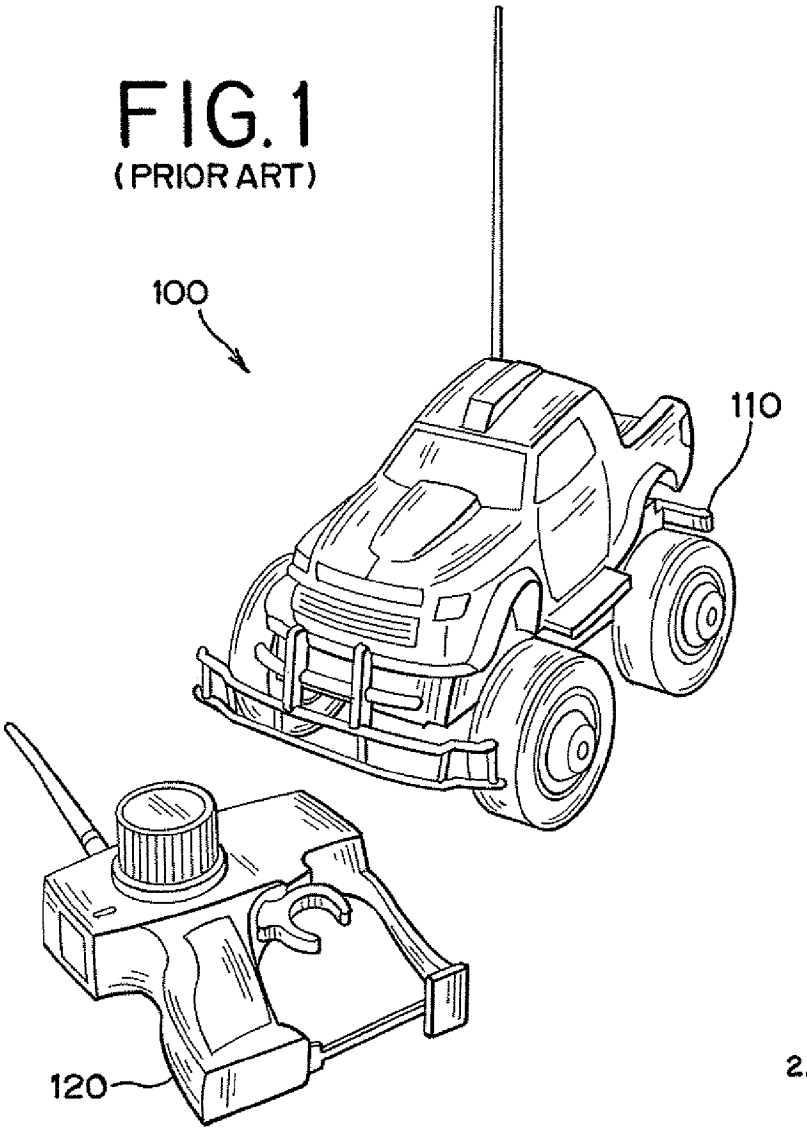
FIG. 1 (PRIOR ART)
FIG. 1 is a perspective view of a prior art complete model vehicle system including a model vehicle and a controller.

With reference to FIG. 1, there is shown a complete model vehicle system, generally designated 100. As used herein, the expression "model vehicle" shall include all types of radio-controlled model vehicles, including model aircraft, model helicopters, model boats, model cars, model trucks, and the like. In the embodiment shown in FIG. 1, a model vehicle 110 may include an engine or motor for driving at least some of the wheels, one or more servomechanisms for controlling the steering of the model vehicle, a receiver for receiving radio control signals from a controller 120, and a battery pack for supplying electrical power to the receiver, to the engine or motor, and to the servomechanisms. Additionally, the model vehicle may include an electrical connector or jack for connecting to a source of electrical power to recharge the battery pack.

If the model vehicle is a model aircraft, the engine or motor may drive one or more propellers or rotors, and a plurality of servomechanisms may move one or more control surfaces, such as ailerons, elevator and/or rudder.

Figure 2:
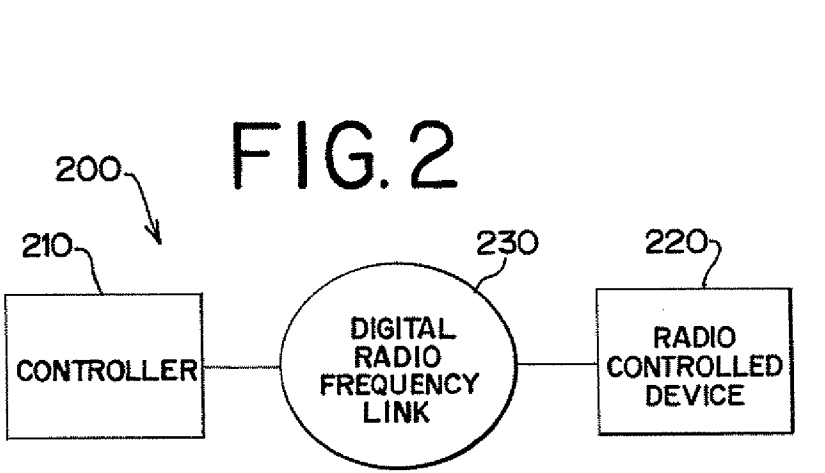
FIG. 2 is a block diagram of a system for controlling a radio controlled device by means of a digital radio frequency link.

Illustrated in FIG. 2 is a radio control system 200, which may include a controller 210 and a radio controlled device 220, such as the model vehicle 110 in FIG. 1. Alternatively, the radio controlled device 220 may be a motorcycle, a boat, an airplane, a helicopter, a military vehicle, or the like. Controller 210 may be coupled with a transmitter module, as further discussed below.

A digital radio frequency link 230 provides a communication path between controller 210 and radio controlled device 220. Preferably, the controller 210 sends coded signals to the receiver in the radio controlled device 220, such as by digital spread spectrum modulation (DSSM) techniques. Digital spread spectrum technology has a high immunity to noise or other interference. In DSSM, a stream of information for transmission is divided into small pieces, each of which is allocated to a frequency channel across the spectrum.

Alternatively, the digital radio frequency link 230 may employ frequency hopping spread spectrum (FHSS) technology. With FHSS, radio signals are transmitted from transmitter 210 to controlled device 220 by rapidly switching a carrier signal over the frequencies associated with channels 304-308 by using a pseudorandom sequence known to both the transmitter and the controlled device. For example, the carrier signal may change channel frequencies about every 400 ms. FHSS transmission is relatively immune to many types of interference and the frequency spectrum 300 in FIG. 3 may be shared with many other transmitters and controlled devices.

Figure 3:
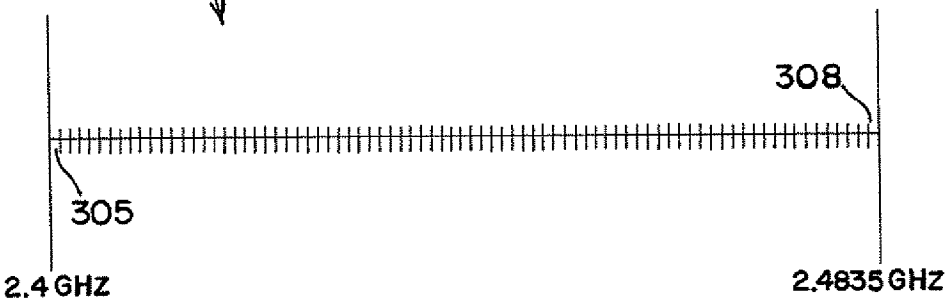
FIG. 3 is a diagram of the frequency spectrum employed by a radio control system.

FIG. 3 illustrates a frequency spectrum 300 suitable for use with DSSM radio controlled transmission techniques. For example, frequency spectrum 300 may extend between about 2.4 GHz to about 2.4835 GHz, or higher. In the embodiment shown in FIG. 3, this frequency spectrum 300 may be subdivided into 79 separate 1 MHz channels 305-308. This may allow up to 79 users to simultaneously and adjacently operate radio controlled systems without interference. Alternatively, a single user may use the available 79 channels to bind up to 79 different model vehicles with a single controller.

Figure 4C:
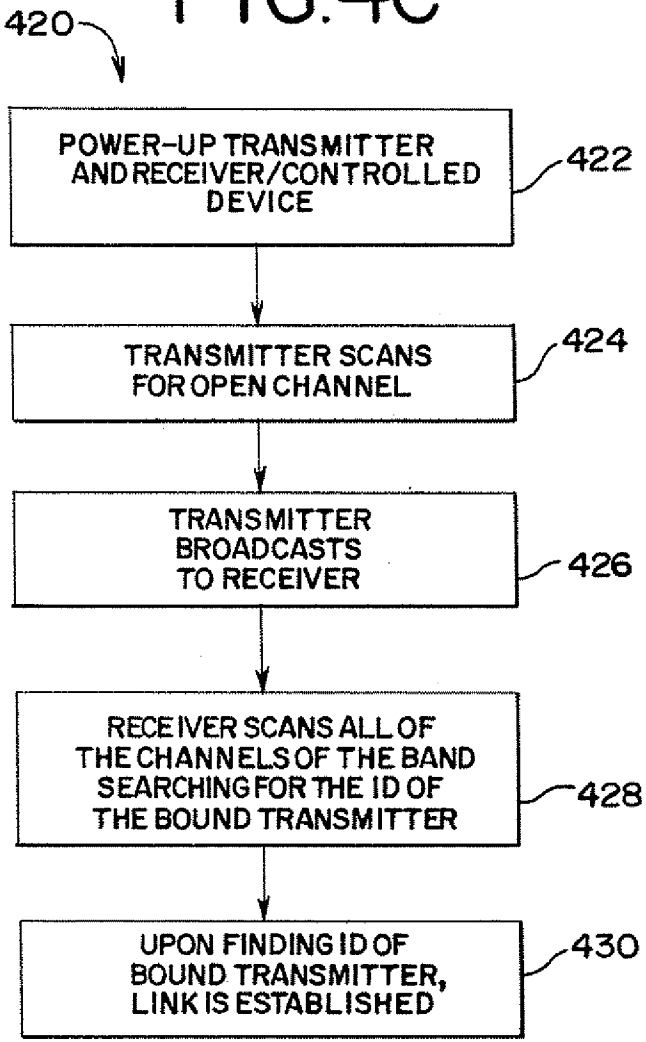
FIG. 4C is a flow diagram of a process for establishing a communication link after the process of locking or binding the controller to the receiver in FIG. 4A.
Figure 4B:
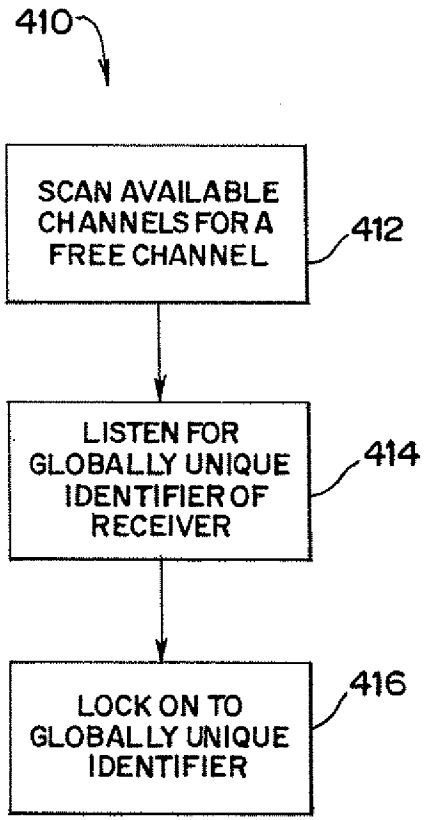
FIG. 4B is a flow diagram of a process for locking or binding a receiver to a globally unique identifier of the transmitter.
Figure 4A:
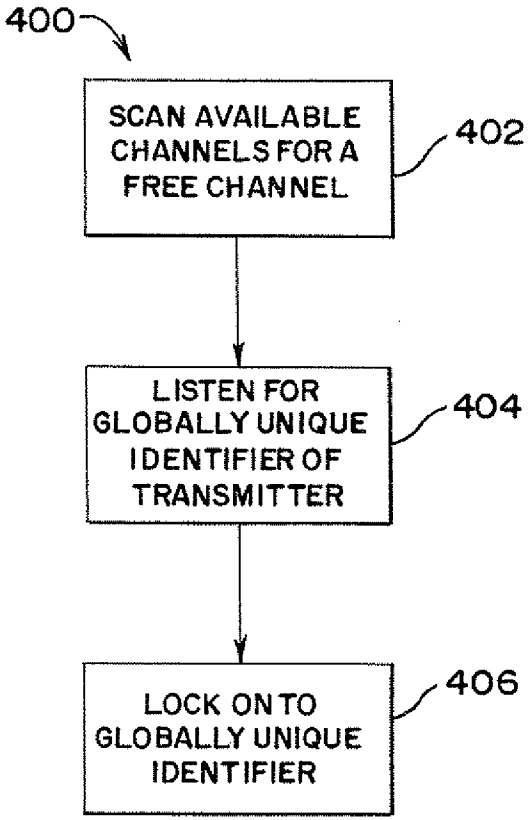
FIG. 4A is a flow diagram of a process for locking a controller to a globally unique identifier of the receiver.

A pair of flow diagrams 400 and 410 in FIGS. 4A and 4B illustrates the process of binding or locking the receiver or controlled device 220 to the controller 210, or, vice versa, binding or locking the controller 210 to the receiver or controlled device 220. The process 400 starts at block 402 by scanning the 79 available channels 305-308 for a free channel to transfer data between controller 210 and radio controlled device 220. When a free channel is detected, the receiver listens for a globally unique identifier (GUID) from the transmitter at block 404. The GUID may be preprogrammed into the transmitter, or a separate code plug may be connected to an available port of the transmitter/controller 210. The receiver may then lock onto the GUID of the transmitter at block 406. Once a receiver is bound to a transmitter, the radio controlled system digitally encodes data and assigns data a unique frequency code. Data is then scattered across the frequency band in a pseudo-random pattern. The receiver deciphers only the data corresponding to a particular code to reconstruct the signal. Thus, the receiver only recognizes signals from the particular transmitter to which it is bound.

FIG. 4B is a flow diagram 410 which illustrates binding or locking of the controller 210 to the receiver or controlled device 220. The process 410 starts at block 412 by scanning the 79 available channels 305-308 for a free channel to transfer data between controller 210 and radio controlled device 220 to initiate data transfer between controller 210 and radio controlled device 220. When a free channel is detected, the transmitter listens for a globally unique identifier (GUID) from the receiver at block 414. The GUID may be preprogrammed into the receiver, or a separate code plug may be connected to a port which may also be used for recharging the batteries of the model vehicle. The transmitter may then lock onto the GUID of the receiver at block 416. Once a transmitter is bound to a receiver, the radio controlled system digitally encodes data and assigns data a unique frequency code. Data is then scattered across the frequency band in a pseudo-random pattern. The receiver deciphers only the data corresponding to a particular code to reconstruct the signal. Thus, the receiver only recognizes signals from the particular transmitter to which it is bound.

FIG. 4C illustrates how communication is established between the controller 210 and the receiver of the controlled device 220 where the receiver is bound to the GUID of the transmitter in accordance with the binding process 400 in FIG. 4A. In block 422, the transmitter in the controller 210 and the receiver in the controlled device 220 are powered up. The transmitter begins to scan the channels 305-308 for an open channel in block 424. Upon finding an open channel, the transmitter begins broadcasting to the receiver at block 426. At about the same time, the receiver is scanning the available channels 305-308 searching for the GUID of the transmitter at block 428. When the receiver finds the transmitter with the correct GUID, the communication link between the transmitter and the receiver is established at block 430.

In some implementations, once the communication link is established at block 430, the receiver may also be able to communicate with the transmitter, for example, with protocol standards, telemetry, and the like.

If the transmitter is bound to the GUID of the receiver in accordance with the flow diagram 410 in FIG. 4B, the operation of the transmitter and receiver will be similar upon power-up to the flow chart 420 of FIG. 4C, except that the transmitter will be searching for the GUID of the receiver at block 428. Upon finding of the GUID of the receiver to which it is bound, a communication link will be established at block 430.

Figure 5:
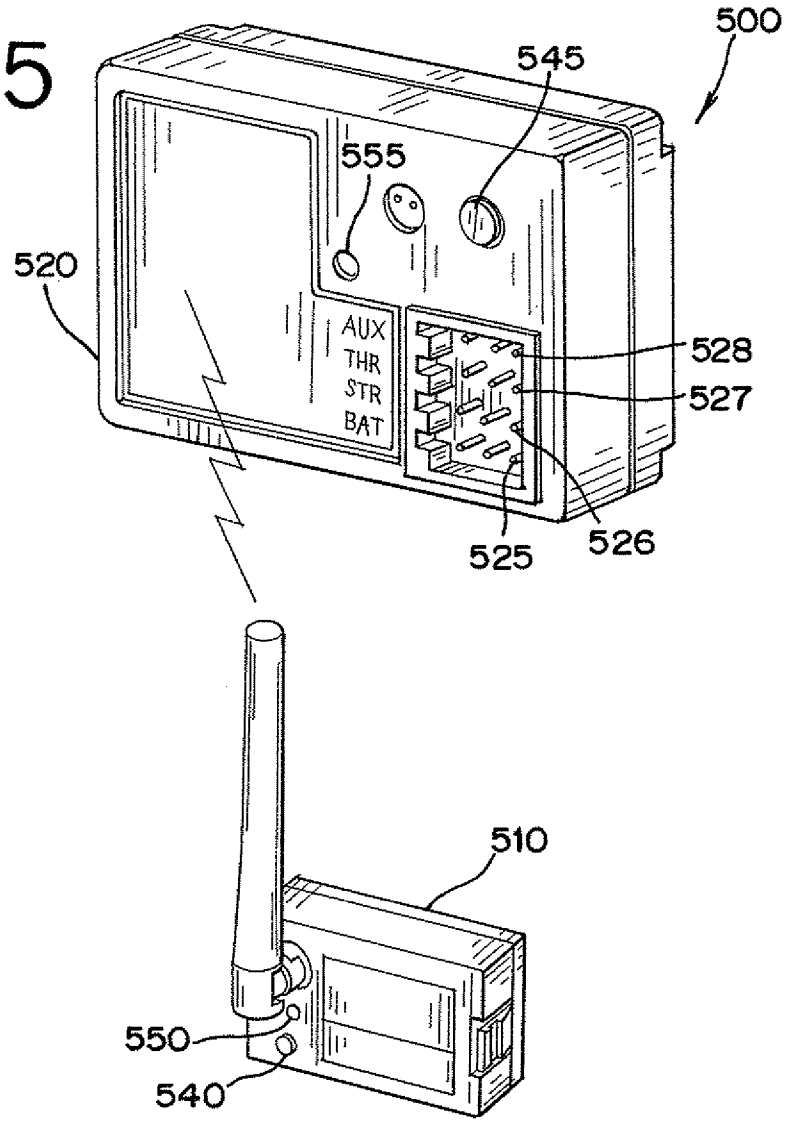
FIG. 5 is perspective view of a transmitter module and a receiver module for the radio controlled system.

FIG. 5 depicts a radio controlled system 500, including a transmitter 510 and a receiver 520. Transmitter 510 may be coupled with a controller 600 in FIG. 6 and receiver 520 may be coupled with a radio controlled device such as vehicle 110. Receiver 520 may contain several ports 525-528. For example, first port 525 may be used for battery and telemetry options, second port 526 may be a steering channel, third port 527 may be a throttle channel, and fourth port 528 may be an auxiliary channel. Transmitter module 510 and receiver module 520 may both include a binding button 540, 545 and a visible alert 550, 555, such as a light emitting diode. These visible alerts may be used during the binding process 400 to confirm that the process has successfully concluded.

Figure 6:
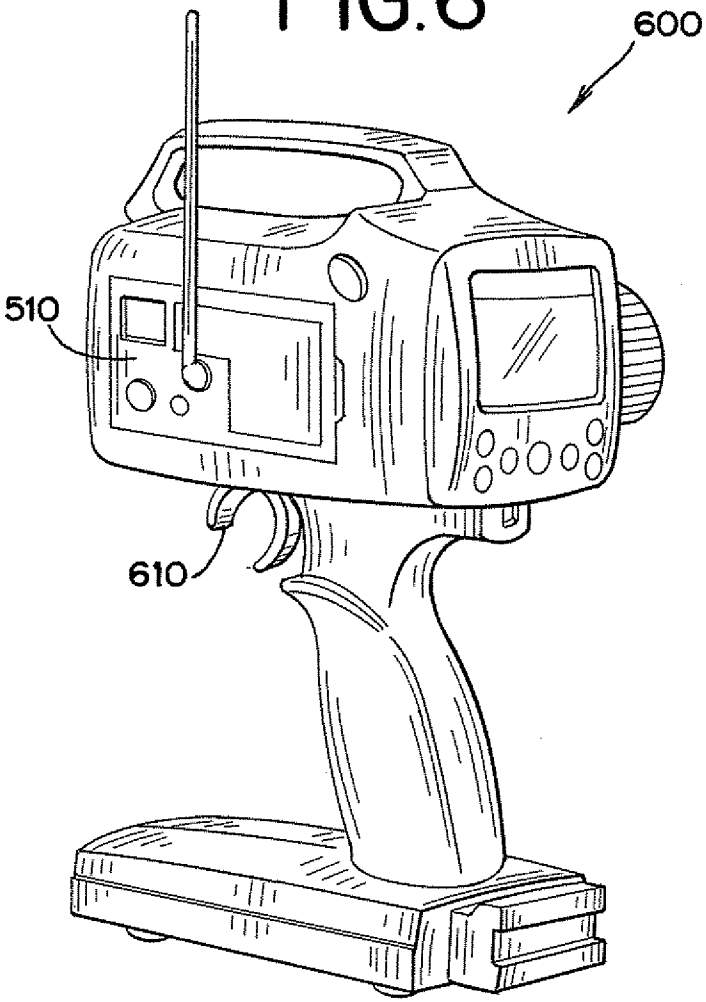
FIG. 6 is a perspective view of a controller which includes the transmitter module shown in FIG. 5.

FIG. 6 illustrates a controller 600, which includes the transmitter module 510. Controller 600 may include one or more controls, such as trigger button 610, for receiving manual inputs from a user, which is translated into data received by transmitter module 510, modulated and sent to receiver module 520.

Figure 7:
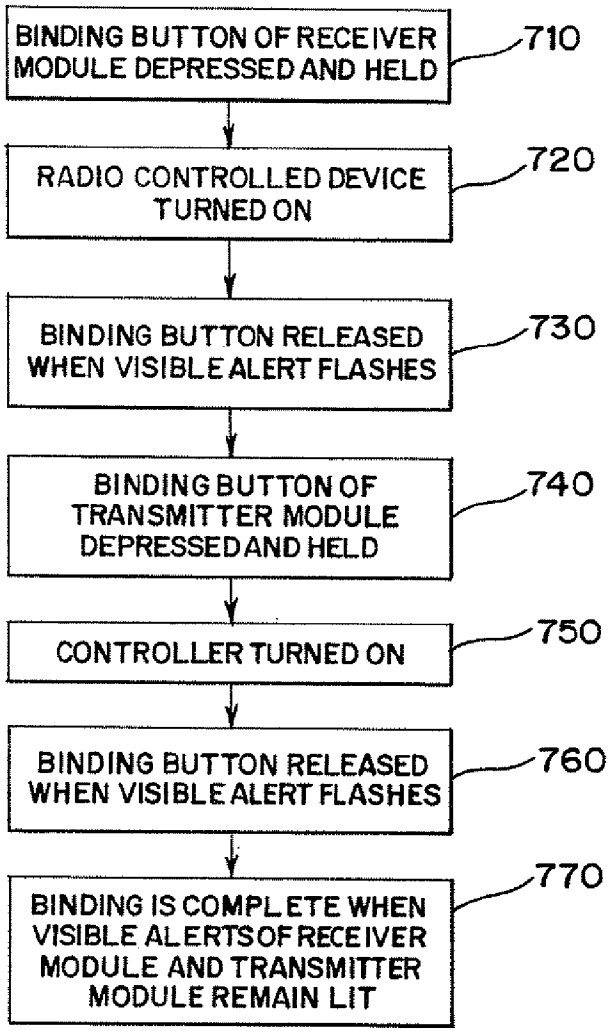
FIG. 7 is a flow diagram illustrating a process for binding a receiver module to a specific transmitter module.

With reference to FIG. 7, a flow chart for a process 700 of binding the receiver module 520 to a specific transmitter module 510 is shown in greater detail shown in FIG. 4. The binding process 700 may be initiated after the transmitter module 510 is installed in a controller 600 and after the receiver module 520 is installed in a radio controlled device 110. At block 710, a binding button 545 of receiver module 520 is depressed and held for a period of time, for example, such as about 3 to 5 seconds. At block 720, the radio controlled device 110 is turned on. When the visible alert 555 of receiver module 520 begins to flash, the binding button 545 may be released at block 730. The binding button 540 of transmitter module 510 may then be depressed and held for a period of time at block 740. The controller 600 may then be turned on at block 750. When visible alert 550 begins to flash, binding button 540 may be released at block 760. When both of the visible alerts 550 and 555 stop flashing and remain lit, the binding process 700 is complete at block 770.

During this binding process 700, the transmitter module 510 may operate at reduced radio frequency (RF) power to avoid accidentally binding to another system in the area. Additionally, fail safe data may be transferred to the receiver module 520, such as initial throttle setting and initial steering setting for the radio controlled device 110.

Controller 600 may have provision for binding to the receivers of other model vehicles, such that controller 600 selectively communicates with a plurality of different model vehicles. Thus, controller 600 may program itself for use with a plurality of model vehicles, each having a receiver that is taught to respond only to a specific GUID code. The user then only needs a single controller for use with a plurality of different model vehicles. The user may then purchase additional model vehicles, also without a controller, and complete the model vehicle systems by programming the receivers in each model vehicle to communicate with the single preexisting controller 600.

If or when desired, the user may decide to purchase a new controller 600 with additional features or capabilities, rather than purchasing a model vehicle which is dedicated to communication with only its original prepackaged and ready-to-fly controller. As a further example, if the single controller 600 experiences some type of malfunction or failure, a single replacement controller will satisfy the communication needs for a plurality of model vehicles 110.

Such a controller 600 is now commercially available from Horizon Hobby, Inc. of Champaign, Ill. as the model DX7 controller. This controller utilizes 2.4 GHz digital spread spectrum modulation technology. The DX7 also has a 20 model memory such that its transmitted signals include the code learned by each of 20 different model vehicles. Each of the models and the associated code for the transmitted signals can be selected by scrolling on its display screen.

Figure 8:
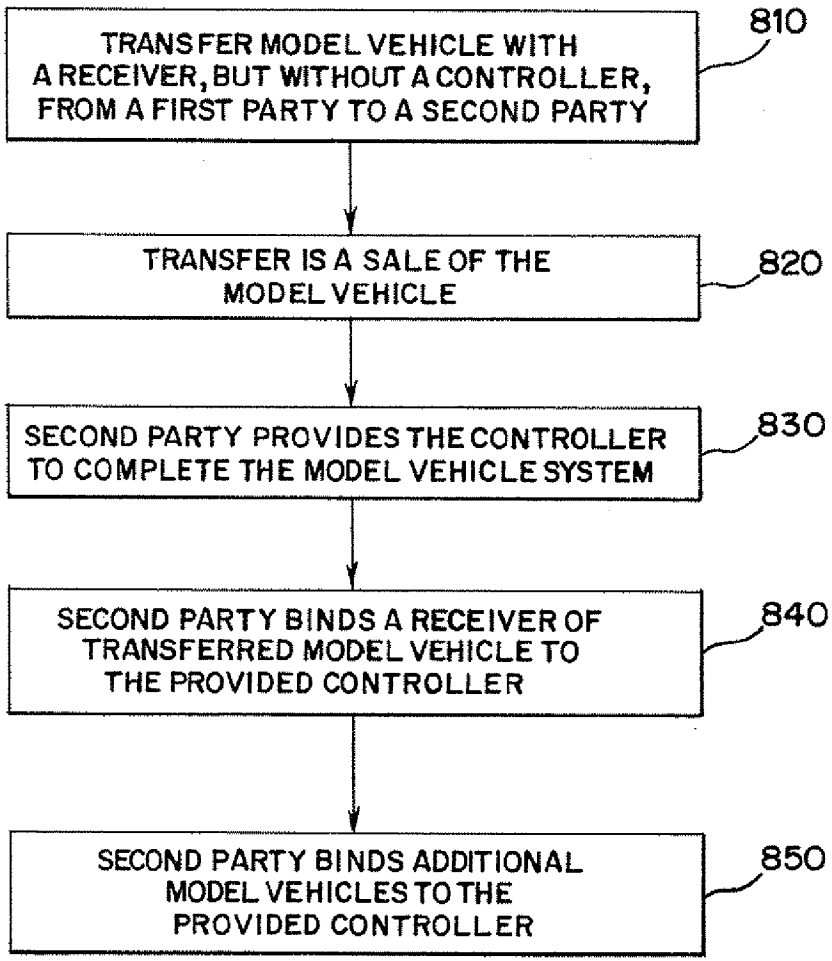
FIG. 8 is a block diagram of methods of completing a model vehicle system with a transferred model vehicle and a provided controller in accordance with an embodiment of the present invention.

FIG. 8 is a block diagram illustrating the methods in accordance with an embodiment of the present invention. In block 810, a first party, such as a seller or retailer, transfers a model vehicle, such as model vehicle 110 in FIG. 1, to the second party. The model vehicle 110 is transferred without a controller, such as controller 600 in FIG. 6. As shown in block 820, the transfer from the first party to the second party may be a sale. At block 830, the second party provides a controller 600 for the model vehicle 110 to complete, and to make operational, the radio controlled system including model vehicle 110 and controller 600. The second party may then bind the receiver, such as receiver module 520 in FIG. 5, in the model vehicle to the provided controller 600 to make the radio controlled system operational.

Thereafter, the second party may acquire additional model vehicles, also without any controller, and bind the additional model vehicles to the same controller. Thus, the second party completes, and makes operational, a plurality of model vehicle systems with a single controller. The second party may therefore be able to purchase or acquire a larger variety of model vehicles since the price for the model vehicles without a controller will be more affordable than a complete system including a controller. Also, the second party does not have to locate a matching controller for each model vehicle before using the desired model vehicle since the single provided controller will properly function with all model vehicles.

Likewise, a user may provide another or substitute controller for communicating with receivers preinstalled in a plurality of model vehicles such that the user may upgrade to a controller with more features and/or capabilities without having to change the receivers already preinstalled in the plurality of model vehicles. The new controller can then learn to bind with each of the previously acquired model vehicles, thereby providing a single replacement or upgraded controller for use with a plurality of model vehicles.

As used herein, the expression "remote control signal source" includes a controller, such as controller 600 in FIG. 6.

While particular embodiments of the invention have been shown and described, it will be obvious to those skilled in the art that changes and modifications may be made therein without departing from the invention in its broader aspects.

The invention clamed is:

1. A method of establishing a fully operable remotely controlled model vehicle system for a model vehicle, said method comprising the steps of:

transferring a model vehicle with a receiver therein for receiving a control signal from a remote control signal source to control operation of the model vehicle, the transfer being from a first party to a second party, and the transfer taking place without the remote control signal source;

the second party providing the remote control signal source following transfer of the model vehicle to the second party to complete the fully operable remotely controlled model vehicle system;

said model vehicle with said receiver being sold or otherwise transferred as a single unit; and whereby by transferring the model vehicle and using the pre-existing remote control signal source of the second party, a complete remotely controlled model vehicle system is provided without the need to purchase or otherwise acquire a remote control signal source from the first party thereby providing a price reduction advantage compared to the price of acquiring a complete system from the first party.

2. The method in accordance with claim 1 wherein the remote control signal source is a controller which transmits control signals to the receiver in the model vehicle.

3. The method in accordance with claim 2, wherein the remote control signal source transmits radio frequency signals.

4. The method in accordance with claim 2, wherein the remote control signal source transmits digital spread spectrum modulated signals.

5. The method in accordance with claim 2, wherein the remote control signal source transmits frequency hopping spread spectrum signals or digital spread spectrum signals.

6. The method in accordance with claim 1, wherein the transfer from the first party to the second party comprises a sale of the model vehicle with the receiver, but without the remote control signal source.

7. The method in accordance with claim 1, comprising the further step of:

binding the receiver of the model vehicle to the remote control signal source.

8. The method in accordance with claim 7, comprising the further step of:

providing a code at the remote control signal source which the receiver uses during the binding step.

9. The method in accordance with claim 8, comprising the further step of:

subsequently using the code in transmission of information from the remote control signal source to the receiver.

10. The method in accordance with claim 8, wherein the code is a globally unique identifier.

11. The method in accordance with claim 8, wherein said receiver, after binding with the remote control signal source, only acts on signals from the remote control signal source which include the code.

12. The method in accordance with claim 8, wherein said remote control signal source also binds to other model vehicles using the same code.

13. The method in accordance with claim 7, comprising the further step of:

providing a code at the receiver which the remote control signal source uses during the binding step.

14. The method in accordance with claim 13, comprising the further step of:

subsequently using the code in transmission of information from the remote control signal source to the receiver.

15. The method in accordance with claim 13, wherein the code is a globally unique identifier.

16. The method in accordance with claim 13, wherein said receiver, after binding with the remote control signal source, only acts on signals from the remote control signal source which include the code.

* * * * *